United States Patent [19]

Shirai et al.

[11] Patent Number: 4,851,741

[45] Date of Patent: Jul. 25, 1989

[54] ELECTRON GUN FOR COLOR PICTURE TUBE

[75] Inventors: Shoji Shirai, Koganei; Yoshiaki Takahashi, Chiba; Masaaki Yamauchi; Masayoshi Furuyama, both of Togane; Kazunari Noguchi; Sakae Ishii, both of Chiba, all of Japan

[73] Assignees: Hitachi, Ltd.; Hitachi Device Engineering Co., Ltd., both of Tokyo, Japan

[21] Appl. No.: 272,911

[22] Filed: Nov. 18, 1988

[30] Foreign Application Priority Data

| | | | |
|---|---|---|---|
| Nov. 25, 1987 | [JP] | Japan | 62-295248 |
| Sep. 7, 1988 | [JP] | Japan | 63-222360 |
| Sep. 16, 1988 | [JP] | Japan | 63-230116 |

[51] Int. Cl.[4] ..... H01J 29/58

[52] U.S. Cl. ..... 315/382; 315/14; 313/414; 313/449

[58] Field of Search ..... 315/382, 14; 313/412, 313/414, 449

[56] References Cited

U.S. PATENT DOCUMENTS 4,772,827 9/1988 Osakabe ..... 313/414

FOREIGN PATENT DOCUMENTS 61-99249 5/1986 Japan .
61-250933 11/1986 Japan .
62-58549 3/1987 Japan .

*Primary Examiner*—Theodore M. Blum
*Attorney, Agent, or Firm*—Antonelli, Terry & Wands

[57] ABSTRACT

An electron gun for color picture tube wherein a focusing electrode adjacent to an acceleration electrode supplied with highest voltage includes two members comprising a first member and a second member, wherein a platelike correction electrode extended into the inside of the first member through a single opening formed in an end face of the first member opposed to the second member is so disposed above and below electron beam passage holes formed in an end face of the second member located at the opposite side with respect to the accelerating electrode and opposed to the first member as to be electrically in contact with the second member, wherein constant voltage is applied to the first member, and wherein voltage so changed in synchronism with electron beam deflection as to have a value increased with increase in the amount of deflection is applied to the second member.

11 Claims, 16 Drawing Sheets

ELECTRON GUN FOR COLOR PICTURE TUBE

BACKGROUND OF THE INVENTION

The present invention relates to the shape of an electrode included in a main lens of an electron gun for color picture tube.

FIG. 2 is a longitudinal section view of a color picture tube having an electron gun of a conventional structure. A phosphor screen 3 alternately coated with three color phosphors in a stripe form is supported on the inner wall of a face plate portion 2 of a glass envelope 1. Respective central axes 15, 16 and 17 of cathodes 6, 7 and 8 coincide with central axes of apertures of a G1 cathode 9, a G2 electrode 10, a focusing electrode 11 constituting a main lens and shield cup 13, corresponding to respective cathodes and are so arranged on a common plane as to be parallel each other. Whereas the central axis of an aperture located at the center of an accelerating electrode 12, which is the other of electrodes constituting the main lens, coincides with the above described central axis, central axes 18 and 19 of both outer apertures do not coincide with their respective central axes 15 and 17 but are slightly displaced from to the outside. Three electron beams emitted from respective cathodes are applied to the main lens along the central axes 15, 16 and 17. The focusing electrode 11 is supplied with focusing voltage of approximately 5 to 10 kV, and the accelerating electrode 12 is supplied with accelerating voltage of approximately 20 to 30 kV. The accelerating electrode 12 has the same potential as that of the shield cup 13 and a conductive layer 5 disposed inside of the glass envelope.

Since the apertures located at respective centers of the focusing electrode and the accelerating electrode are coaxial, the main lens formed at the center becomes axisymmetric. After the central beam has been converged by the main lens, it goes straight ahead on a trajectory along the axis. On the other hand, outer apertures of the focusing electrode and the accelerating electrode have axes displaced each other. At the outer sides, therefore, main lenses which are not axisymmetric are formed. In a diverging lens region formed in the acceleration electrode side of the main lens region, therefore, each of the outer beams passes through a portion located nearer to the central beam with respect to the center axis of the lens and undergoes converging force directed toward the central beam concurrently with the focusing effect applied thereto by the main lens. Three electron beams thus form an image on a shadow mask 4, and at the same time converge so as to overlap each other. Such action of converging beams is referred to as static convergence (hereafter abbreviated to STC). Further, respective electron beams undergo color selection in the shadow mask. Only components which excite phosphors having colors corresponding to respective beams to emit light pass through apertures of the shadow mask and arrive at the phosphor screen. In order to scan the phosphor screen with the electron beam, an external magnetic deflection yoke 14 is disposed.

When an in-line electron gun having three electron beam paths disposed on one horizontal plane is combined with a so-called self convergence deflection yoke forming special nonuniform magnetic field distribution, it is known that if STC is established at the center of the screen, convergence is obtained over the entire remaining regions of the screen. In a typical self convergence deflection yoke, however, deflection defocusing is large because of nonuniformity of the magnetic field, resulting in a problem of lowered resolution at peripheral parts of the screen. FIG. 3 schematically shows deformation of an electron beam spot caused by deflection defocusing. At peripheral parts of the screen, the high luminance portion (core) of the electron beam indicated by the shaded region expands in the horizontal direction, while the low luminance portion (halo) expands in the vertical direction.

One means for solving this problem is shown in JP-A-61-99249. FIGS. 4A to 4C show an example of structure of an electron gun according to this prior art. The focusing electrode is bisected into a first member 114 and a second member 115 in a direction extending from the cathode to the phosphor screen. 0n an end face of the first member 114 opposed to the second member 115, slits elongated in the longitudinal direction are fomed as shown in FIG. 4B. On an end face of the second member 115 opposed to the first member, slitlike apertures elongated in the horizontal direction are formed as shown in FIG. 4C and are supplied with voltage, which changes dynamically in synchronism with the deflection current supplied to the deflection yoke, i.e., dynamic voltage superimposed over the focusing voltage Vf. When the amount of deflection is large, the potential difference between the first member 114 and the second member 115 becomes large. Therefore, refractive power of a quadrupole-lens formed by the slits becomes high, and large astigmatism is caused in the electron beam spot. If the potential of the second member 115 is higher than the potential of the first member and the third member, astigmatism caused in the electron beam has an effect of elongating the core in the vertical direction and elongating the halo in the horizontal direction. Therefore, it becomes possible to cancel astigmatism caused by electron beam deflection as shown in FIG. 3 and enhance the resolution at peripheral parts of the screen. On the other hand, the resolution is not deteriorated when the electron beam is not deflected. Because such a condition that astigmatism is not caused at the central parts of the screen can be established by eliminating the potential difference between the first member and the second member to prevent a nonsymmetrical lens from being formed.

In color picture tubes, the distance from the main lens to the peripheral parts of the screen is larger than the distance from the main lens to the central part of the screen. Therefore, the condition of electron beam focusing at the central part and the peripheral parts differs. If the electron beam is focused at the central part, it is not focused at the peripheral parts, resulting in a problem of deteriorated resolution there. In the conventional example shown in FIG. 4, however, the potential of the second member 114 is raised when the electron beam is to be deflected to the peripheral part of the screen. Therefore, the potential difference between the potential of the second member 114 and the accelerating voltage of the accelerating electrode 12 is reduced, and the refractive power of the main lens is weakened. Accordingly, the focusing point of the electron beam is extended in the screen direction, and the electron beam can be focused onto the screen even at the peripheral parts of the screen. From this point as well, it is possible to prevent the resolution at the peripheral parts from being deteriorated. That is to say, it is possible to realize dynamic astigmatism correction and dynamic focus simultaneously.

FIGS. 5A to 5C illustrate another embodiment shown in JP-A-61-250933. In the same way as the embodiment shown in FIGS. 4A to 4C, the focusing electrode is divided into two members 116 and 117. As shown in FIGS. 5B and 5C, vertical and horizontal correction electrodes taking the shape of that plate are so arranged on confronting faces of respective members as to be combined each other, a quadrupole lens being formed. Dynamic voltage Vd superimposed over the focusing voltage Vf is applied to the second member 117 to realize dynamic astigmatism correction and dynamic focus simultaneously.

Further, in JP-A-62-58549, there is shown means of solving a problem of the above described conventional example that application of dynamic voltage lowers the refractive power of the main lens and the converging force applied to outer beams caused by nonaxisymmetric components of the lens, resulting in unsuccessful convergence.

FIGS. 6A to 6C show the structure of an electron gun according to this conventional example. On opposed end faces of the first member 130 and the second member 140 of the focusing electrode as shown in FIGS. 6B and 6C, longitudinal elongated apertures are combined with lateral elongated apertures to form a quadrupole lens in the same way as the conventional example shown in FIG. 4. It is now assumed that outer beam passage holes of a G1 electrode 110 and a G2 electrode 120, outer beam passage holes formed at the G2 electrode side of the first member 130 of the focusing electrode, outer beam passage holes formed on opposed faces of the first member 130 and the second member 140, and outer beam passage holes formed on opposed faces of the second member 140 and the accelerating electrode 150 are located respectively at distance S1, S2, S3 and S4 from the center axis of the electron gun and these distance values are related each other as $$S1<S2<S3<S4.$$

In this embodiment, the main lens is so formed as to be axisymmetric, and nonaxisymmetric lenses supplying the converging force to the outer beams are formed on opposed faces of the G2 electrode and the first member. As a result, convergence is not affected even if the refractive power of the main lens is lowered due to a change in dynamic voltage.

The above described prior art has a problem that extremely high precision is demanded in fabrication of components of the electron gun and fabrication of the electron gun. That is to say, when the longitudinal slits are combined with the lateral slits or the longitudinal platelike correction electrodes are combined with the lateral correction electrodes in conventional examples of FIGS. 4A to 4C and FIGS. 5A to 5C, even slight mutual displacement from the desired position causes nonuniform force effected upon the electron beam at the time of astigmatism correction, resulting in a deformed spot on the screen.

Further, in the embodiment of FIGS. 6A to 6C, fabrication of the electron gun becomes further difficult because spaces S1, S2, S3 and S4 of the electron beam passage holes are mutually different. Further, the embodiment of FIGS. 6A to 6C also has a problem that comatic aberration is caused because the outer beam enters the lens slantly.

SUMMARY OF THE INVENTION

An object of the present invention is to provide an electron gun structure capable of attaining dynamic astigmatism correction and dynamic focus simultaneously without requiring as high precision as that of the prior art in production of components and their fabrication.

In the prior art, precision of components and fabrication must be made high because two kinds of electrodes having different structures must be accurately combined. In the first member of the G3 electrode, therefore, only a single large aperture is formed on its face opposed to the second member. And the structure for forming the quadrupole lens comprises only a correction electrode taking the shape of flat plate, which is disposed above and below electron beam passage holes on a face of the second member opposed to the first member and which is extended inside the first member through the above described aperture.

In the electrode structure according to the present invention as described above, an electrode portion belonging to the first member, which is disposed in proximity to the electron beam near the opposed faces of the first and the second members does not exist. When the first member is combined with the second member, therefore, high precision is not demanded with respect to the mutual position relationship.

Another object of the present invention is to provide an electron gun structure in which a problem for beam convergence is not caused even when dynamic voltage is applied.

As means for solving the problem of beam convergence, an electrode plate having electron beam passage holes formed within the first member is added to the above described electrode structure according to the present invention, or a second platelike correction electrode which is extended from the above described electrode plate in the direction of the second member, which is opposed to the above described platelike correction electrode via a distance, and which is disposed perpendicular to the platelike correction electrode is provided.

In the above described electrode structure according to the present invention, coaxial circular apertures having equal diameters are formed on opposed faces of the first member and the second member confronting each other via the platelike correction electrode. Unlike the embodiment shown in FIGS. 4A to 4C, therefore, the first member and the second member can be combined with extremely high precision by using a cylindrical through builtup jig which is conventionally used in assembling of electron guns.

Further, since space between respective electron beam passage holes is not changed from the focusing electrode to the G1 electrode, the assembly precision is not lowered, and mass production problems are not caused.

DESCRIPTION OF THE PREFERRED EMBODIMENTS

Figure 1A:
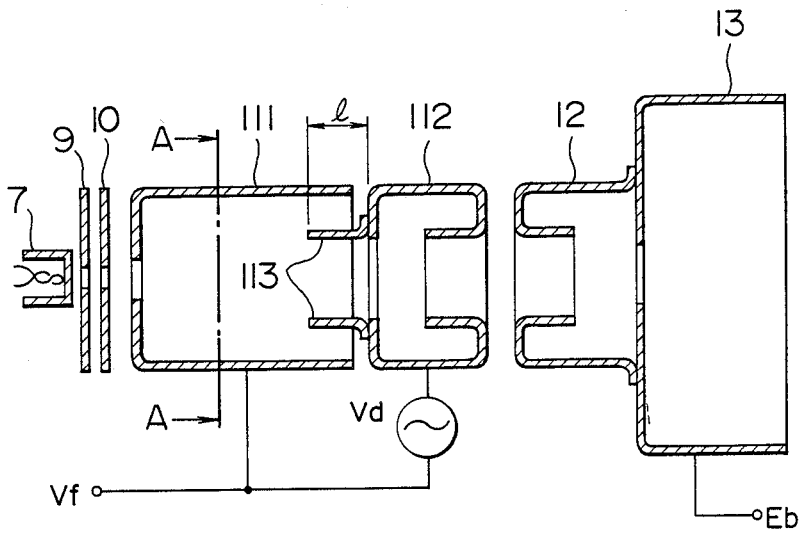
Figs. 1A and 1B a longitudinal section view of an embodiment of an electron gun according to the present invention and a cross-sectional view of its principal part, respectively.
Figure 1B:
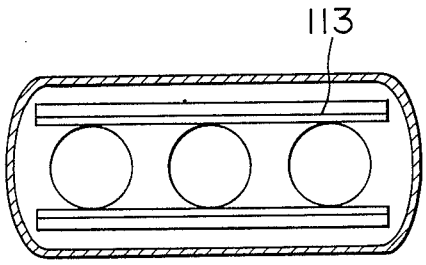
Figure 2:
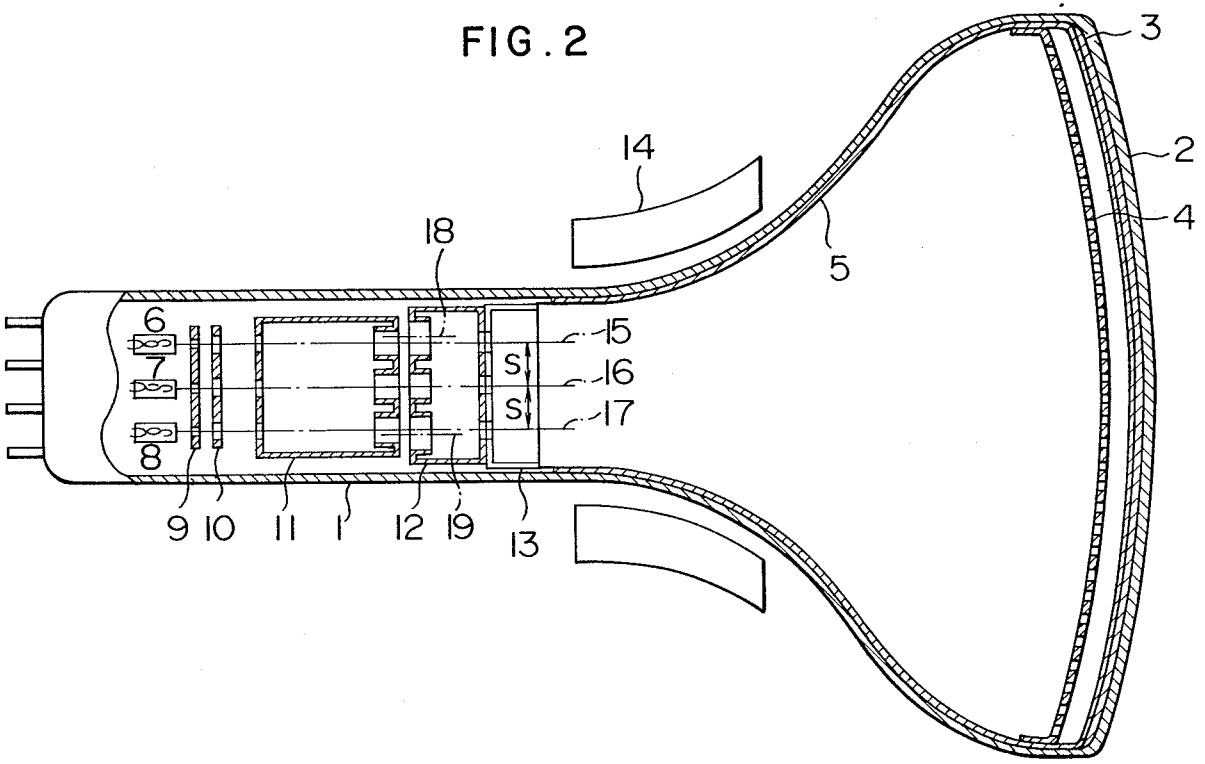
FIG. 2 is a longitudinal section view of a color picture tube having a conventional electron gun.

FIGS. 1A and 1B show an embodiment of the present invention. The focusing electrode is divided into a first member 111 and a second member 112. A single laterally elongated aperture is formed on the first member. Three circular electron beam passage holes are formed on an end face of the second member 112 opposed to the first member. Above and below the passage holes, plate-like correction electrodes (horizontal plates) 113 extended in the direction of the first member are connected.

Constant focusing voltage Vf is applied to the first member 111, and dynamic voltage Vd superimposed over Vf is applied to the second member 112. When the electron beam is deflected, Vd is raised as the amount of deflection is increased. As Vd is raised, refractive power of a quadrupole lens formed on opposed faces of the first member 111 and the second member 112 is increased, and astigmatism caused by electron beam deflection can be corrected. At the same time, the refractive power of the main lens is lowered because of reduction in voltage difference between acceleration voltage Eb of an acceleration electrode 12 and voltage applied to the second member 112. Since the distance between the main lens and the focus point of the electron beam thus becomes long, the electron beam can be focused even at peripheral parts of the screen.

That is to say, dynamic astigmatism correction and dynamic focus can be simultaneously performed.

In the electrode structure of FIG. 1, the first member 111 is not in proximity to the electron beam passway near its quadrupole lens portion, i.e., its portion opposed to the second member 112. Even if the position of the first member is somewhat displaced from its desired position with respect to the second member, therefore, characteristics of the quadrupole lens are not largely affected. Accordingly, high precision is not needed for the assembly of the electrode.

Figure 7:
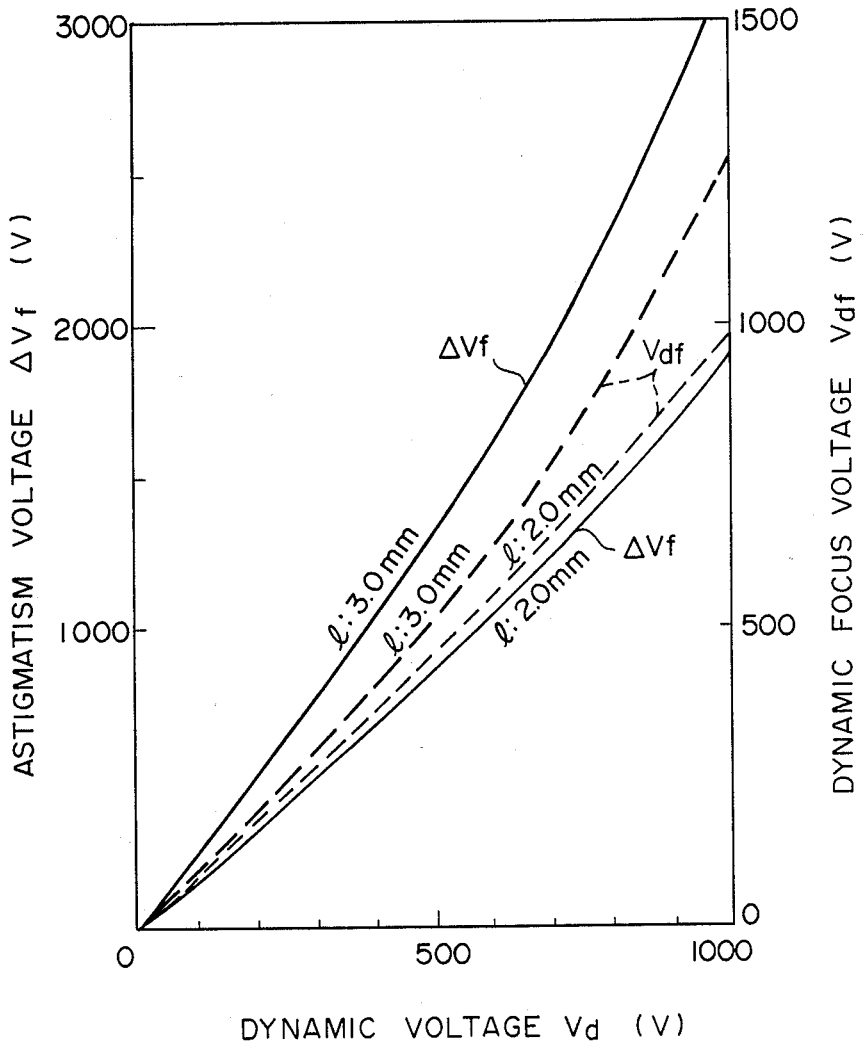
FIG. 7 is a graph showing analytical results of electron gun characteristics of an embodiment according to the present invention.

FIG. 7 shows results of analysis of characteristics of astigmatism correction and dynamic focus of the embodiment shown in FIG. 1. Conditions of analysis are as follows.

Acceleration voltage Eb: 25 kV

Focusing voltage Vf: 6kV

Distance between main lens and central portion of screen: 340 mm

Figure 3:
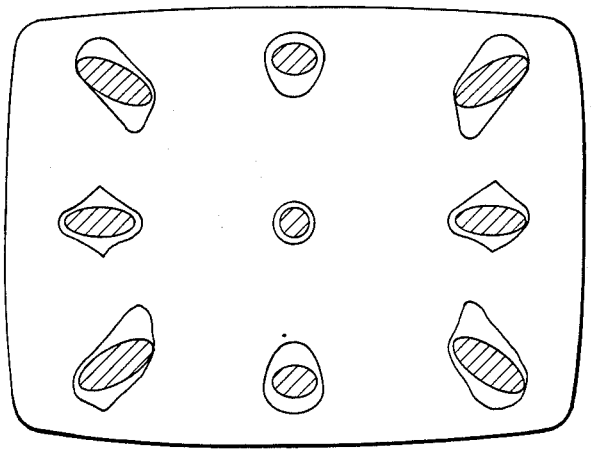
FIG. 3 schematically shows electron beam spot shapes appearing at respective portions of a screen of a color picture tube having a conventional electron gun.
Figure 4A:
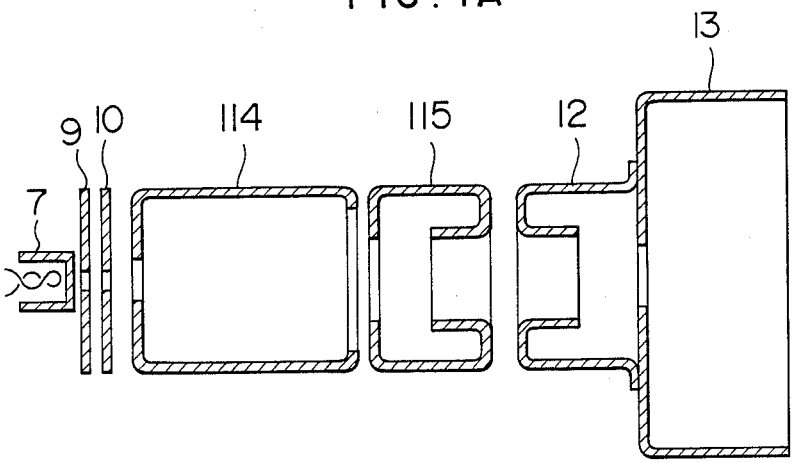
FIGS. 4A, 5A and 6A are longitudinal section views of conventional electron guns.
Figure 4B:
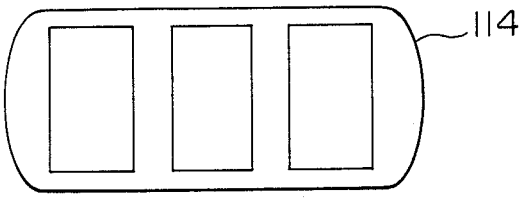
FIGS. 4B and 4C, 5B and 5C, and 6B and 6C are top views of principal parts of the electron guns shown in FIGS. 4A, 5A and 6A, respectively.
Figure 4C:
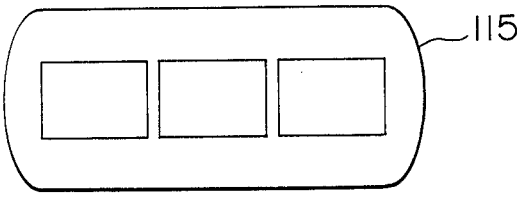
Figure 5A:
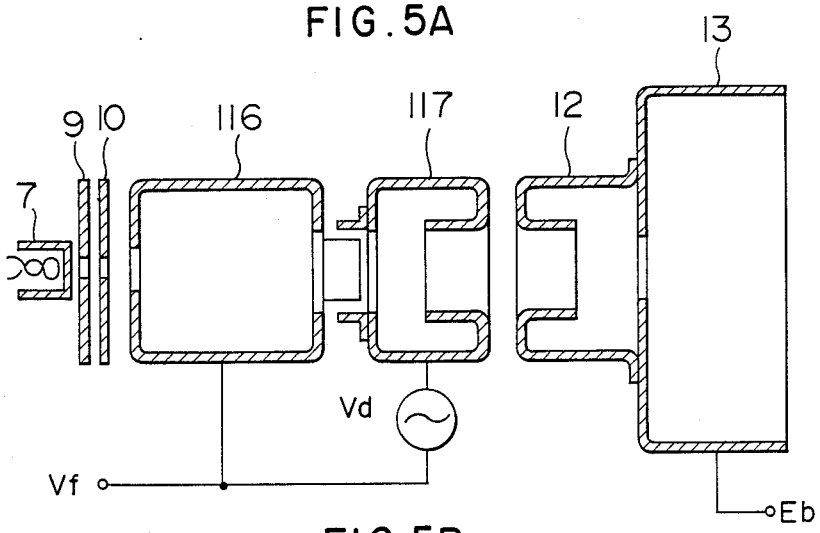
Figure 5B:
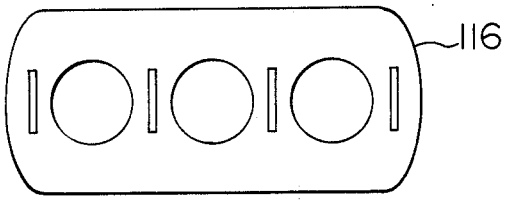
Figure 5C:
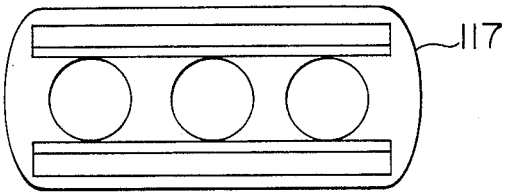
Figure 6A:
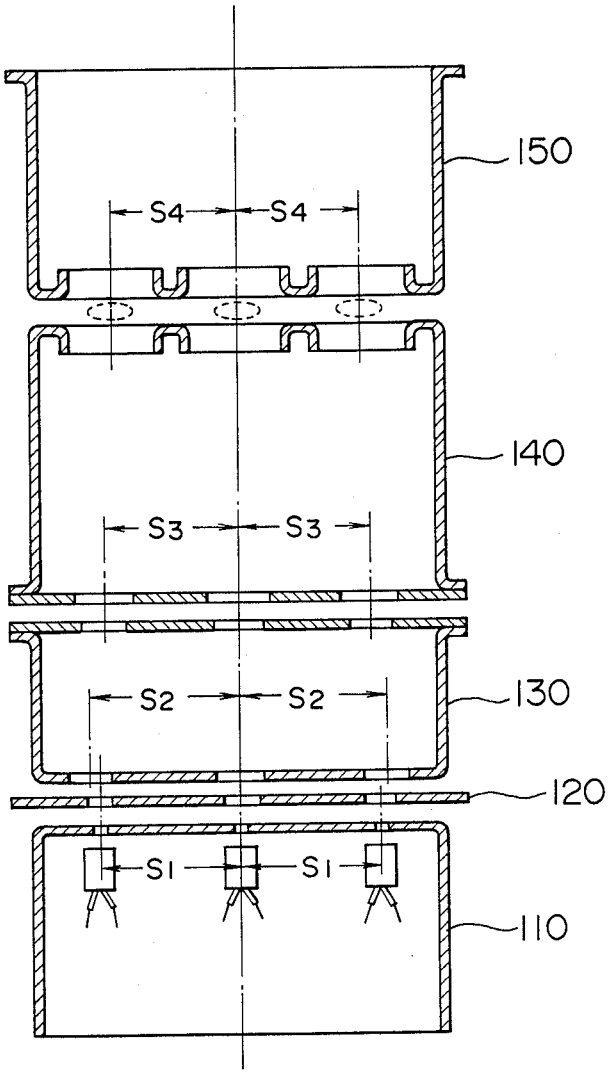
Figure 6B:
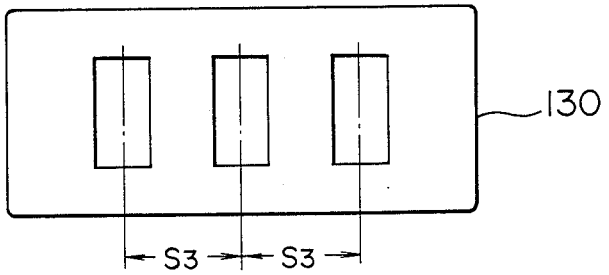
Figure 6C:
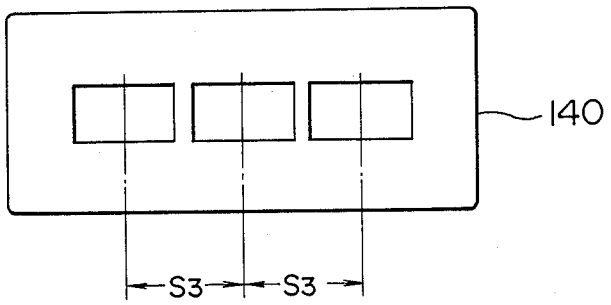

Amount l of extension of horizontal plate 113 in direction of the first member 111: 2.0 mm, 3.0 mm Astigmatism correction characteristics are represented by the value of astigmatism voltage ΔVf and indicated by a solid line in FIG. 7. The ΔVf is the value obtained by subtracting the value of focusing voltage capable of canceling the halo of the electron beam spot caused in the horizontal direction at the center of the screen of the picture tube from the value of focusing voltage capable of just canceling the halo caused in the vertical direction. If the dynamic voltage Vd is zero, the quadrupole lens is not formed, and astigmatism is not generated at the center of the screen, and hence ΔVf becomes zero. As Vd is raised, the refractive power of the quadrupole lens increases and astigmatism becomes strong. If ΔVf has a positive value, such astigmatism as to extend the core of the electron beam in the longitudinal direction is generated, and hence the astigmatism and astigmatism caused by deflection as shown in FIG. 3 cancel each other. If dynamic voltage of 1 kV is applied, astigmatism with the value of ΔVf of approximately −3 kV can be corrected when l is 3.0 mm, and astigmatism with ΔVf of −1.9 kV can be corrected when l is 2.0 mm.

Dynamic focus characteristics are represented by the value of dynamic focus voltage Vdf as indicated by broken lines in FIG. 7. It is understood that dynamic focus can be performed concurrently with astigmatism correction because Vdf increases nearly in proportion to the dynamic voltage Vd.

Figure 8:
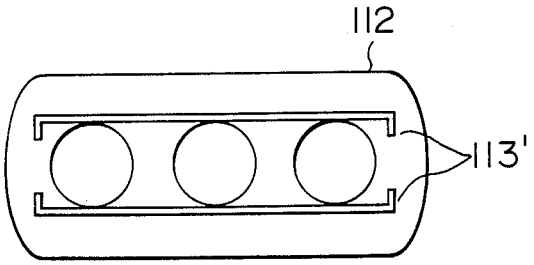
FIG. 8 is a top view of a principal part of another embodiment of an electron gun according to the present invention.
Figure 9A:
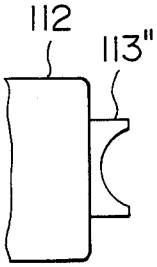
FIGS. 9A and 9B are a top view and a side view of a primary part of another embodiment of an electron gun according to the present invention, respectively.
Figure 9B:
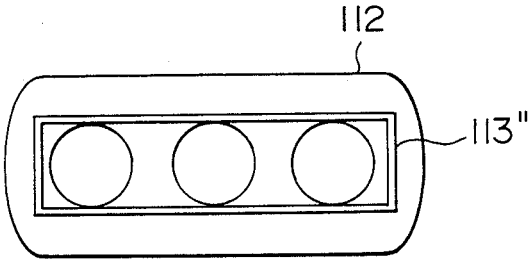

FIG. 8 and FIGS. 9A and 9B show other embodiments of the present invention. The embodiment shown in FIGS. 1A and 1B has a problem described below. Since the quadrupole lens exerts different effect upon a central beam side portion of the outer electron beam and its opposite portion located at the electrode side and the wall side, there is a possibility that distortion occurs in the electron beam spot on the screen. This is caused by the fact the portion of the outer electron beam located at the electrode side and wall side is largely affected by the influence of the side wall of the first member 111 whereas the central beam side portion is not so largely affected.

The above described problem is solved by changing the shape of a horizontal plate 113 so as to shield the influence of the side wall of the first member 111. In the embodiment of FIG. 8, both ends of a horizontal plate 113' are bent to mitigate the influence of the side wall portion of the first member 111. In the embodiment of FIG. 9, portions located above and below the electron beam passage holes of a horizontal plate 113'' are connected together to form a monobloc component, and the connection portion is curved in a concave form as shown in FIG. 9A. In the same way as the embodiment of FIG. 8, the influence of the side wall of the first member 111 is mitigated.

Owing to the present invention, correction of astigmatism caused by electron beam deflection and dynamic focus can be simultaneously attained in a color picture tube, the resolution at peripheral parts of the screen being largely improved. At this time, high precision needed for an electron gun of the prior art performing astigmatism correction is not needed in the assembly of an electron gun. Accordingly, an increase in production cost can be prevented.

Figure 10A:
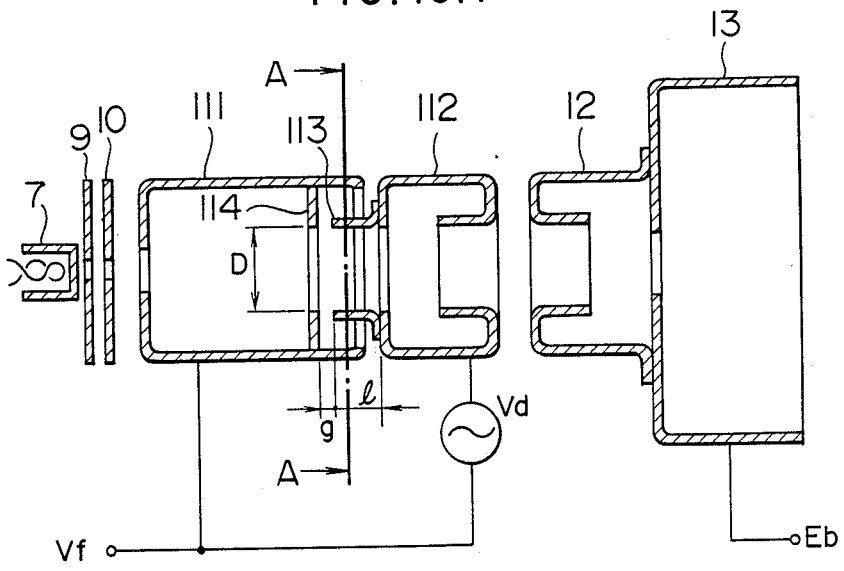
FIGS. 10A to 10C show a vertical section view of an embodiment of an electron gun according to the present invention and front views of its principal part.
Figure 10B:
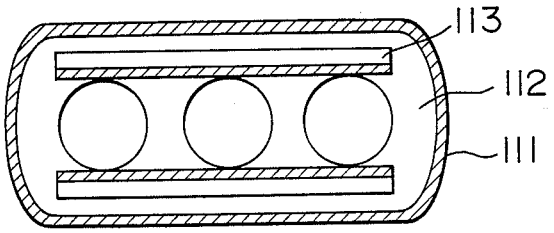
Figure 10C:
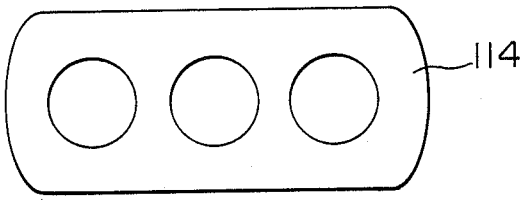

FIGS. 10A to 10C show another embodiment of the present invention. The focusing electrode is divided into a first member 111 and a second member 112. A single laterally elongated aperture is formed on the first member. An electrode plate 114 having three circular electron beam passage holes is disposed inside the first member 111. Three circular electron beam passage holes are formed on an end face of the second member 112 opposed to the first member. Above and below the passage holes, platelike correction electrodes (horizontal plates) 113 extended in the direction of the first member are connected. The above described electron beam passage holes on the electrode plate 114 and the second member 112 corresponding to respective electron beams are coaxial and have equal diameters.

Constant focusing voltage Vf is applied to the first member 111, and dynamic voltage Vd superimposed over Vf is applied to the second member 112. When the electron beam is deflected, Vd is raised as the amount of deflection is increased. As Vd is raised, refractive power of a quadrupole lens formed on opposed faces of the first member 111 and the second member 112 is increased, and astigmatism caused by electron beam deflection can be corrected. At the same time, the refractive power of the main lens is lowered because of reduction in voltage difference between acceleration voltage Eb of an acceleration electrode 12 and voltage applied to the second member 112. Since the distance between the main lens and the focus point of the electron beam thus becomes long, the electron beam can be focused even at peripheral parts of the screen.

That is to say, dynamic astigmatism correction and dynamic focus can be simultaneously performed.

In the electrode structure shown in FIGS. 10A to 10C, circular beam passage holes formed in the electrode plate 114 and circular beam passage holes of the second member 112 located at the first member 111 side are coaxial each ether and have equal diameters. By penetrating the cylindrical builtup jig conventionally used in assembling of electron guns through respective holes, therefore, extremely high assembly precision can be obtained.

Figure 11:
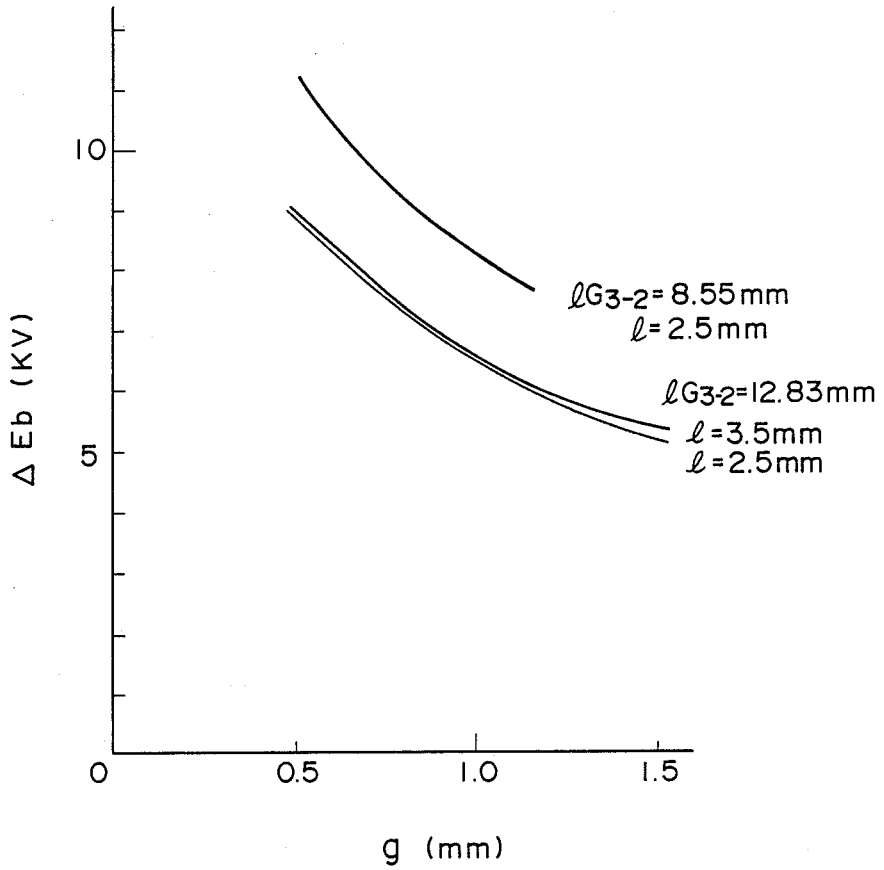
FIGS. 11 and 13 are graphs showing analytical results of characteristics of an embodiment of an electron gun according to the present invention.

FIG. 11 shows results of analysis of characteristics of astigmatism correction of the embodiment shown in FIG. 10. Principal dimensions of the electron gun which has been analyzed are as follows.

Total length of focusing electrode: 26.33 mm

Space between the first member 111 of focusing electrode and the second member 112 thereof: 0.5 mm Diameter D of circular beam passage holes in electrode plate 114 and in electrode face of the second member 112 located at the first member 111 side and distance D between upper and lower electrodes of horizontal plate 113: 4 mm Further, it is assumed that the length of the horizontal plate 113, the space between the horizontal plate and the electrode plate 114, and the length of the second member 112 are l, g, $lG_{3-2}$, respectively.

The astigmatism characteristics were analyzed in accordance with the procedure described below. The focusing voltage Vf is defined to be a constant value (7.4 kV in the present analysis), and dynamic voltage Vd is superimposed to the second member 112. For each Vd, Eb is changed. Voltage values Ebv and Ebh respectively minimizing electron beam diameters at the central portion of the screen in the vertical direction and in the horizontal direction are derived. And the voltage difference of Eb between the vertical direction and the horizontal direction represented as $$\Delta Eb = Ebv - Ebh$$

is calculated. If Vd has a positive value and the refractive power of the quadrupole lens is increased, Ebv becomes larger than Ebh and ΔEb becomes positive. This means that when the electron beam is to be focused in the vertical direction the refractive power of the main lens formed between the second member 112 of the focusing electrode and the acceleration electrode 13 must be made larger than that required when the electron beam is to be focused in the horizontal direction. It is also meant that as constant Eb the core of the electron beam spot is extended in the vertical direction and the halo is extended in the horizontal direction. This astigmatism generated by the static quadrupole lens has an effect of canceling the astigmatism generated by electron beam deflection as shown in FIG. 3. If the value of ΔEb is large with respect to the same Vd, therefore, it follows that the sensitivity of astigmatism correction caused by the quadrupole lens is high. FIG. 11 shows values of ΔEb as functions of g for various values of l and $lG_{3-2}$ under the condition that the dynamic voltage Vd is 1 kV. As evident from FIG. 11, the astigmatism correction sensitivity scarcely depends upon the length l of the horizontal plate 113 and depends greatly on the space g between the horizontal plate 113 and the electrode plate 114. The electrode plate 114 has an effect of enhancing the astigmatism correction sensitivity. The smaller the value of g becomes, the higher the sensitivity becomes. Further, the relationship between the position of the quadrupole lens and the astigmatism correction sensitivity is also known from FIG. 11. The shorter the total length $lG_{3-2}$ of the second member 112 becomes, i.e., the shorter the distance between the position of the quadrupole lens and the position of the main lens formed between the second member 112 and the acceleration electrode 13, the higher the astigmatism correction sensitivity becomes.

In the embodiment shown in FIGS. 10A to 10C, the problem of beam convergence can also be solved. As the dynamic voltage Vd is raised, the potential difference between the acceleration voltage Ed and the voltage of the second member 112 is reduced at the main lens portion, and hence the electric field becomes weak. Accordingly, nonaxisymmetric components of electric field functioning to deflect the outer beam toward the central beam to converge the beam also become weak simultaneously, and the amount of deflection of the outer beam drops. In the embodiment shown in FIGS. 10A to 10C, however, the amount of deflection of the outer beam is increased at the quadrupole portion as the dynamic voltage Vd is raised. It is thus possible to compensate for the above described drop and always achieve convergence even if Vd changes.

Figure 12:
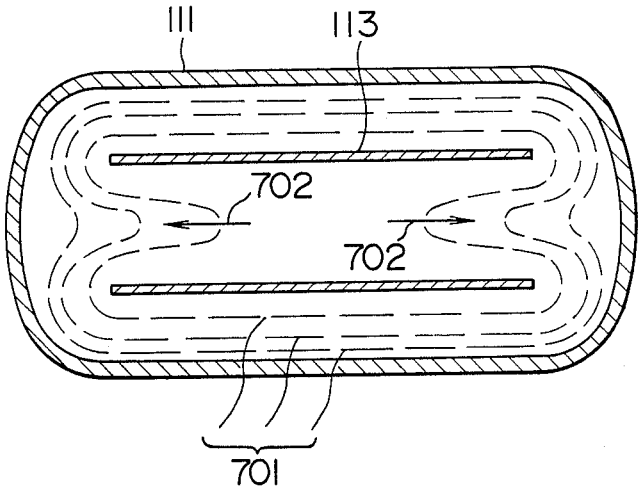
FIG. 12 schematically shows a vertical section of an embodiment shown in FIG. 1 and distribution of equipotential lines inside the electron gun.

How beam is deflected at the quadrupole lens portion will now be described by referring to FIG. 12. FIG. 12 schematically shows the distribution of equipotential lines seen in section AA of the embodiment of FIGS. 10A to 10C. As shown, equipotential lines 701 enter inside between two horizontal plates 113. Since the potential of the first member is lower than that of the horizontal plate 113, electric fields are generated in directions indicated by arrows 702 in FIG. 12. Since the outer beam is subject to force in a direction opposite to that of the electric field, the outer beam is deflected toward the central beam. As the dynamic voltage Vd is raised, this electric field becomes further stronger and the amount of deflection of the outer beam increase.

Figure 13:
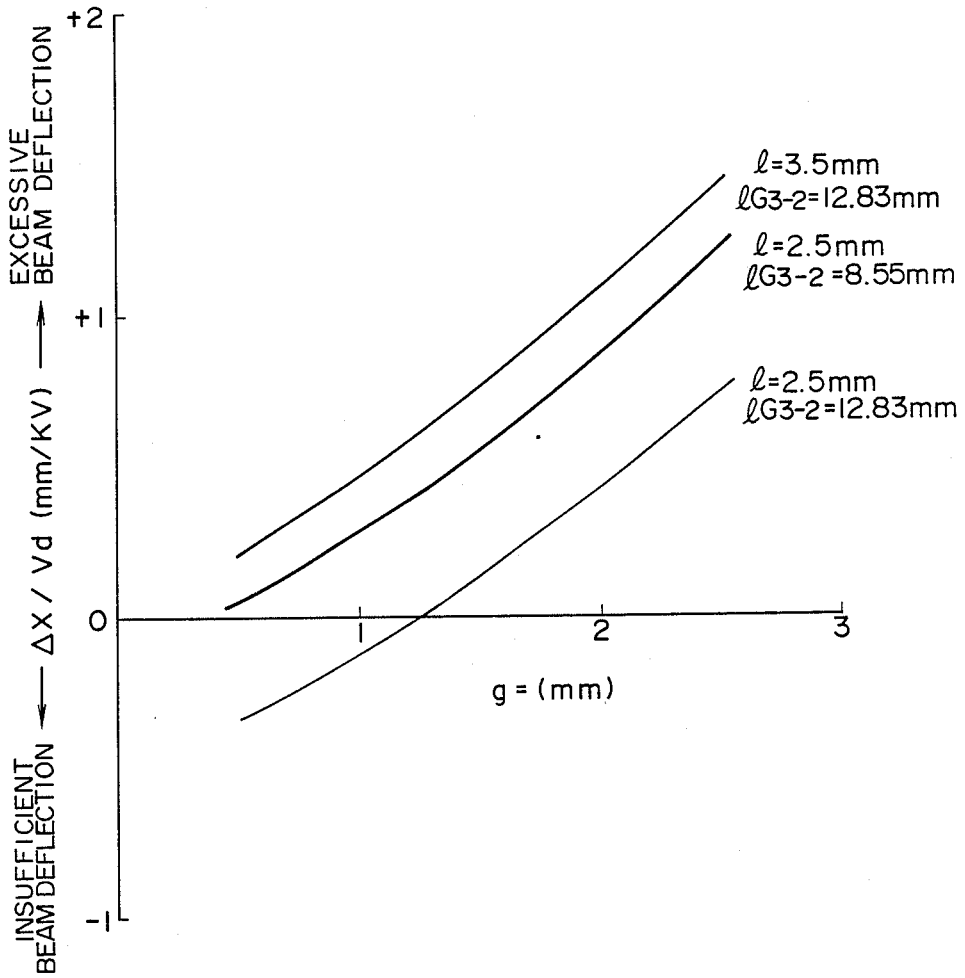

FIG. 13 shows the result of analysis of the amount of convergence change as functions of g for various values of l and $lG_{3-2}$. In FIG. 13, $\Delta x$ of the coordinate axis represents the distance in the horizontal direction between two outer beams at the central portion of the screen obtained when the dynamic voltage Vd is increased by 1 kV. If $\Delta x$ is 0, the convergence is not changed by Vd. If $\Delta x$ has a positive value, the beam deflection becomes excessively large as Vd is increased, and three beams converge before they reach the screen. When $\Delta x$ has a negative value, the beam deflection, on the contrary, becomes insufficient as Vd is increased. The beams do not converge yet when they reach the screen.

By choosing l, g and $lG_{3-2}$ suitably, it becomes possible to make $\Delta x$ equal to 0 and solve the problem of beam convergence. Especially if l is changed, convergence alone can be independently adjusted without affecting the astigmatism correction sensitivity, electrode design being facilitated.

Figure 14:
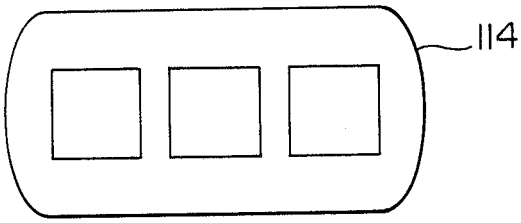
FIGS. 14 and 15 are front views of principal parts of another embodiment according to the present invention.

In the embodiment shown in FIGS. 10A to 10C, electron beam passage holes formed in the electrode plate 114 are circular. Any shape having equal diameters of the hole in the horizontal and vertical directions such as the square shown in FIG. 14 has an effect similar to that of the embodiment shown in FIGS. 10A to 10C, because the electrode can be assembled with high precision by using a cylindrical electrode builtup jig.

Figure 15:
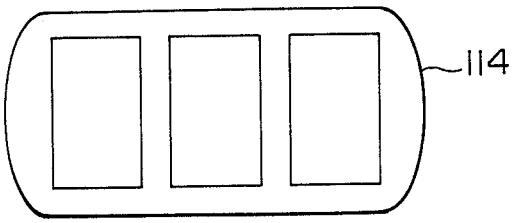

FIG. 15 shows an embodiment in which the electron beam passage holes formed in the electrode plate 114 are rectangular. In this case, the position precision of the electrode plate 114 in the vertical direction becomes insufficient when a circular builtup jig is used. If the diameter of the electron beam passage hole in the vertical direction is sufficiently larger than the space between the upper and lower platelike correction electrodes 113, however, the influence of the position shift in the vertical direction is shielded by the horizontal plates 113, the problem being eliminated. In the shape of electron beam passage holes shown in FIG. 15, the astigmatism correction sensitivity can also be improved.

In case the diameter of the electron beam passage hole in the horizontal direction is larger than that in the vertical direction as well, the problem of beam convergence can be solved. However, such holes are not desirable because the astigmatism correction sensitivity and electrode assembly precision are lowered.

Figure 16A:
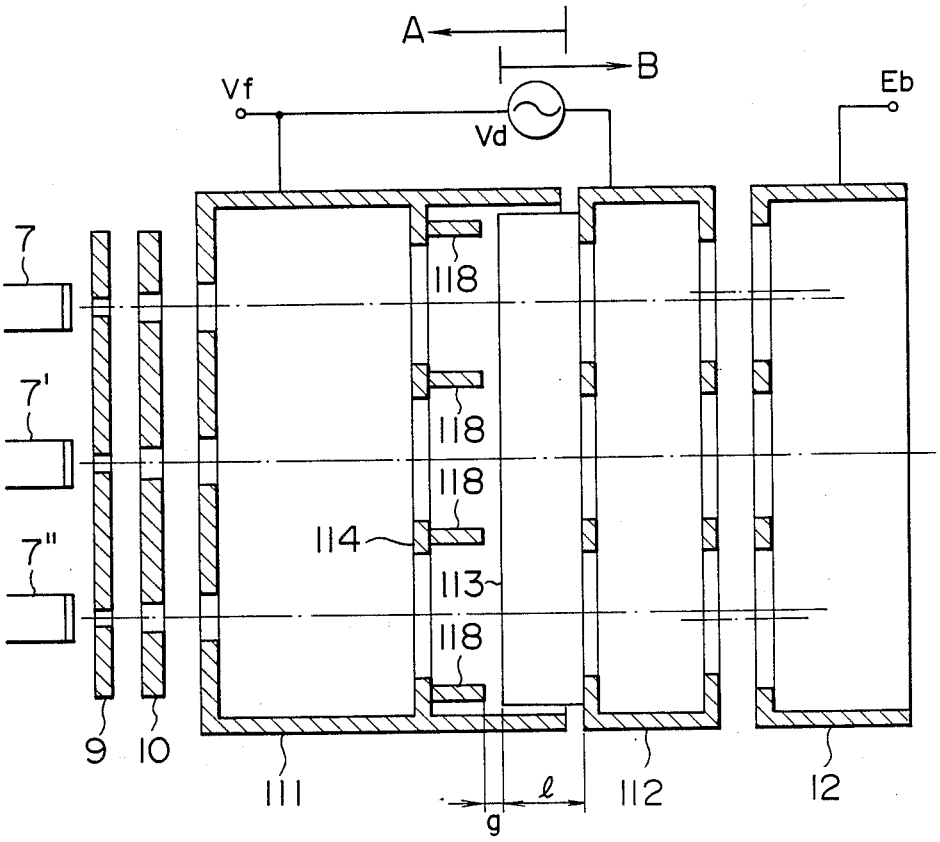
FIGS. 16A to 16C are diagrams used for explaining an embodiment of an electron gun for color picture tube according to the present invention.
Figure 16B:
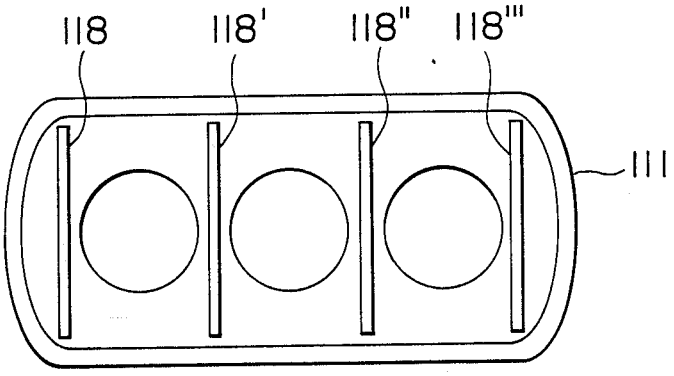
Figure 16C:
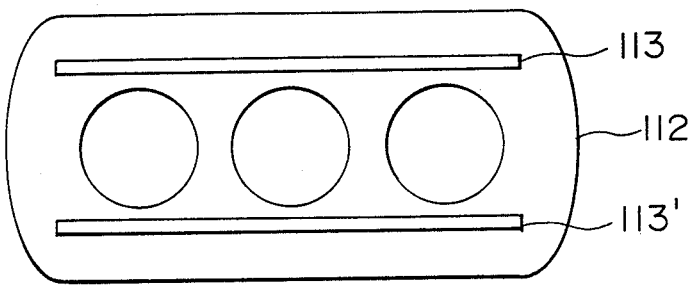

FIGS. 16A to 16C show another embodiment of the present invention. In the embodiment shown in FIGS. 16A to 16C, platelike correction electrodes (vertical plates) 118, which are connected to an electrode plate 114 having electron beam passage holes provided on the first member 111 and which are extended in the direction of the second member, are so provided as to be perpendicular to the horizontal plate 113 and opposed to the horizontal plate 113 with a space g in order to solve the problem of convergence and enhance the astigmatism correction sensitivity. In this case as well, it is possible to adjust convergence by means of the length l of the horizontal plate 113 forming the quadrupole lens and adjust the astigmatism correction sensitivity by means of the gap g and the length $lG_{3-2}$ of the second member 112 in the same way as the embodiment shown in FIGS. 10A to 10C.

Figure 17A:
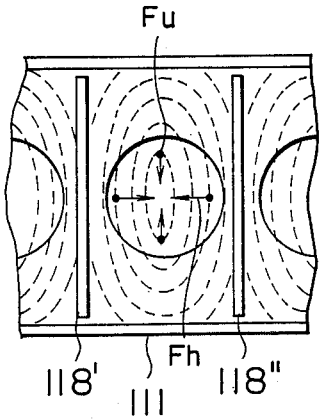
FIGS. 17A and 17B are diagrams used for explaining the electric field operation of a quadrupole lens caused by a first focusing electrode and a second focusing electrode of an electron gun shown in FIG. 16.
Figure 17B:
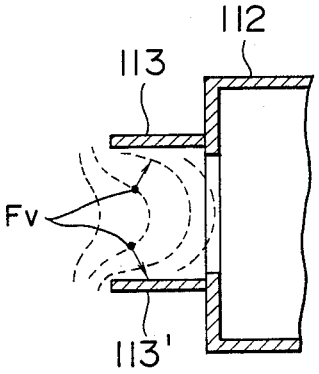

FIGS. 17A and 17B are drawings for explaining the quadrupole lens electric field action caused by the first member and the second member of the electron gun shown in FIGS. 16A to 16C. FIG. 17A is a partial front view of the first member. FIG. 17B is a partial section view of the second member.

In FIGS. 17A and 17B, Fh, Fu, and Fv represent forces exerted upon electron beams by the electric field, and the same numerals as those of FIGS. 16A to 16C denote identical parts.

The electric field formed by vertical plates 118, 118', 118'' and 118''' within the first member 111 and horizontal plates 113 and 113' is a so-called quadrupole lens electric field. In each of sections formed between the vertical plates 118 and 118', between 118' and 118'', and between 118'' and 118''' within the first member 111 of FIG. 17A (only the section between 118' and 118'' is illustrated), a focusing electric field, which is weak in the vertical direction and which is strong in the horizontal direction, is formed. And the electron beam is largely focused in the horizontal direction by force of Fh−Fu (where Fh>Fu). Between horizontal plates 113 and 113' attached to the second member 112 as shown in FIG. 17B, a diverging lens, which is strong in the vertical direction and which exerts little influence in the horizontal direction, is formed. And the electron beam is largely diverged in the vertical direction by force of Fv.

Between the first member 111 and the second member 112, therefore, the electron beam has a longitudinally elongated section in the vertical direction. By thus canceling the action of deforming the electron beam passing through the deflecting magnetic field so as to have a laterally elongated section shape in the horizontal direction, the electron beam is prevented from being laterally elongated and flattened.

Further, as the amount of deflection of the electron beam increases, the distance from the main lens to the phosphor screen becomes long. Accordingly, the degree of overfocus of the electron beam having an increased amount of deflection on the phosphor screen is also lightened. It becomes possible to converge the electron beam with optimum focus not only at the central part of the phosphor screen but also at peripheral parts thereof. And a nearly perfect circular beam spot is obtained.

In the embodiments heretofore described, horizontal plates 113 (113') provided on the second member 112 get into the inside of the first member 111. However, this is not a necessary condition. The front end of the horizontal plate may be located near the front end of the first member 111.

Further, the front end portion T of the first member 111 projects toward the second member 112 as compared with front ends of vertical plates 118, 118', 118'' and 118''' to produce force of Fa as shown in FIG. 17B.

And this front end portion of the first member also has a shield effect of preventing the lens electric field from being affected by charges electrified on the inside wall of the neck or the like of the picture tube.

In the above described embodiment, it is possible to attain convergence of the center electron beam and side electron beam over the entire face of the phosphor screen while maintaining the small diameter and nearly circular shape of the electron beam spot, i.e., without degrading the resolution.

Further, the present invention is not limited to an electron gun having a single stage of focusing electrode as described above, but is applicable to an electron gun having multistage focusing electrodes. In the above described embodiments, horizontal plate is composed of one pair of electrode, and the beam passage holes in the end face of the second member opposed to the first member are formed separately for each electron beam. However, horizontal plate can be devided into separate parts corresponding to each electron beam, and the beam passage hole in the face of the second member can be a single laterally elongated hole passing whole electron beams.

In the above described embodiments, in-line tri-electron beam electron guns having three cathodes have been described. However, it is a matter of course that the present invention is not limited to such electron guns but is also applicable to an electron gun having a single cathode common to three electron beams and various electron guns having a plurality of electron beams other than three electron beams.

Owing to the present invention heretofore described, it is possible to obtain an electron gun for color picture tube having high resolution characteristics and fine convergence characteristics over the entire face of the phosphor screen. In addition, it becomes possible to coaxially dispose side electron beam passage holes formed between respective electrodes constituting the electron gun. And accurate alignment is easy. As a result, it is possible to provide electron guns for color picture tube largely contributing to improvement in production yield and quality because of simplified assembling and having excellent functions.

We claim:

1. An electron gun for color picture tube including first electrode means for generating a plurality of electron beams and for directing said electron beams to a phosphor screen along parallel original passways located on one horizontal plane, second electrode means included in a main lens for focusing said electron beams onto the phosphor screen, and a deflection yoke for deflecting said electron beams to make them scan on the phosphor screen, wherein a focusing electrode adjacent to an acceleration electrode supplied with highest voltage includes two members comprising a first member and a second member;

platelike correction electrodes extended into the inside of the first member through a single opening formed in an end face of the first member opposed to the second member are so disposed above and below electron beam passage holes formed in an end face of the second member located at the opposite side with respect to the accelerating electrode and opposed to the first member as to be electrically in contact with the second member;

constant voltage is applied to the first member; and said constant voltage superimposed by dynamic voltage so changed in synchronism with electron beam deflection as to have a value increased with increase in the amount of deflection is applied to the second member.

2. An electron gun for color picture tube according to claim 1, wherein the space between said platelike correction electrodes located above and below said electron beam passage holes is shorter at end portions of said platelike correction electrodes as compared with that at central portions thereof.

3. An electron gun for color picture tube according to claim 1, wherein said platelike correction electrodes located above and below said electron beam passage holes are connected together at both ends, and the amount of extension of the connection portion in the direction toward said second member is large in the vicinity of said platelike correction electrodes and is small at a middle portion located between said platelike correction electrodes.

4. An electron gun for color picture tube according to claim 1, wherein an electrode plate disposed inside said first member and opposed to said platelike correction electrode with a fixed interval is electrically connected to said first member and has electron beam passage holes, and diameter of said electron beam passage holes in a direction parallel to said one horizontal plane is equal to or smaller than diameter in a direction perpendicular to said one horizontal plane.

5. An electron gun for color picture tube according to claim 4, wherein the shape of the electron beam passage holes disposed in said electrode plate is circular.

6. An electron gun for color picture tube according to claim 4, wherein the shape of the electron beam passage holes disposed in said electrode plate is square.

7. An electron gun for color picture tube according to claim 4, wherein the diameter of the electron beam passage holes formed in said electrode plate, which is measured in a direction perpendicular to said one horizontal plane, is larger than the space between said upper and lower platelike electrodes.

8. An electron gun for color picture tube according to claim 4, wherein the shape of the electron beam passage holes formed in said electrode plate is rectangular.

9. An electron gun for color picture tube according to claim 1, comprising a second platelike correction electrode including a plurality of parallel flat plates so established on an electrode plate, which in turn is disposed inside said first member, in a direction approaching said second member as to sandwich respective electron beams passing through electron beam passage holes formed in the electrode plate within said first member, in the electron beam arranging direction.

10. An electron gun for picture color tube according to claim 1, said platelike correction electrodes are devided into separate parts, and said each separate parts are disposed above and below each electron passage.

11. An electron gun for color picture tube according to claim 1 or 10, wherein the electron beam passage holes formed in said first member comprise either three longitudinally elongated holes having longer diameter in a direction perpendicular to said electron beam arranging direction and passing three electron beams separately or three circular holes, and the electron beam passage holes formed in said second member comprise either three laterally elongated holes having longer diameter in said electron beam arranging direction and passing three electron beams or three circular holes passing three electron beams separately.

* * * * *